US008246130B2

(12) United States Patent
Cho

(10) Patent No.: US 8,246,130 B2
(45) Date of Patent: Aug. 21, 2012

(54) DOOR ASSEMBLY OF REFRIGERATOR

(75) Inventor: Nam Seon Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 1307 days.

(21) Appl. No.: 10/824,350

(22) Filed: Apr. 15, 2004

(65) Prior Publication Data

US 2004/0207304 A1 Oct. 21, 2004

(30) Foreign Application Priority Data

Apr. 17, 2003 (KR) ..... 10-2003-0024213

(51) Int. Cl.
*A47B 96/00* (2006.01)
*A47B 95/02* (2006.01)

(52) U.S. Cl. ..... 312/402; 312/348.6

(58) Field of Classification Search ..... 312/405, 312/326, 327, 328, 329, 348.6, 244, 402; 16/436, 412, 415; 49/460, 480; 403/393; 407/103

See application file for complete search history.

(56) References Cited

U.S. PATENT DOCUMENTS

| | | | | | |
|---|---|---|---|---|---|
| 235,425 | A | * | 12/1880 | Gearon | 30/309 |
| 1,629,667 | A | * | 5/1927 | Knipple | 407/103 |
| 1,652,018 | A | * | 12/1927 | Kubelka | 16/436 |
| 3,545,060 | A | * | 12/1970 | Kezran | 407/103 |
| 3,545,061 | A | * | 12/1970 | Michael | 407/90 |
| 3,629,919 | A | * | 12/1971 | Trevarrow, Jr. | 407/103 |
| 3,885,282 | A | * | 5/1975 | Pataky | 407/89 |
| 4,209,047 | A | * | 6/1980 | Weill | 144/208.8 |
| 4,709,737 | A | * | 12/1987 | Jonsson | 144/241 |
| 4,852,622 | A | * | 8/1989 | Eriksson | 144/208.8 |
| 5,084,940 | A | * | 2/1992 | Loffler et al. | 16/412 |
| 5,297,010 | A | * | 3/1994 | Camarota et al. | 362/501 |
| 5,460,212 | A | * | 10/1995 | Darden | 144/208.8 |
| 5,542,795 | A | * | 8/1996 | Mitchell | 407/35 |
| 6,146,061 | A | * | 11/2000 | Larsson | 407/103 |
| 6,401,302 | B1 | * | 6/2002 | Josserand et al. | 16/444 |
| 6,536,996 | B2 | * | 3/2003 | Satran et al. | 407/34 |
| 6,672,867 | B1 | * | 1/2004 | Du | 432/250 |
| 6,834,692 | B2 | * | 12/2004 | Lindsay et al. | 144/241 |
| 2002/0093276 | A1 | * | 7/2002 | Kawakami | 312/405 |
| 2002/0152582 | A1 | * | 10/2002 | Sueyoshi et al. | 16/412 |
| 2004/0010888 | A1 | * | 1/2004 | Wing et al. | 16/436 |
| 2005/0066479 | A1 | * | 3/2005 | Kim et al. | 16/436 |

FOREIGN PATENT DOCUMENTS

DE 3606805 * 12/1987

* cited by examiner

*Primary Examiner* — James O Hansen
*Assistant Examiner* — Matthew Ing
(74) *Attorney, Agent, or Firm* — Birch, Stewart, Kolasch & Birch, LLP

(57) ABSTRACT

A door assembly of a refrigerator, preventing damage from occurring on a handle holder thereof. The door assembly includes a door opening and closing the refrigerator, a handle provided on a side of the door, a plurality of handle holders each having an end fixed to the door and another end attached to the handle, and a supporting member provided on each of the handle holders and preventing damage from occurring on the handle holder.

12 Claims, 4 Drawing Sheets

DOOR ASSEMBLY OF REFRIGERATOR

CROSS-REFERENCE TO RELATED APPLICATIONS

This application claims the benefit of Korean Application No. P2003-024213, filed on Apr. 17, 2003, which is hereby incorporated by reference as if fully set forth herein.

BACKGROUND OF THE INVENTION

1. Field of the Invention

The present invention relates to a refrigerator, and more particularly, to a door assembly of a refrigerator. Although the present invention is suitable for a wide scope of applications, it is particularly suitable for preventing damage from occurring on a handle holder of the door assembly.

2. Discussion of the Related Art

A refrigerator is an appliance used to store and keep food fresh for a long period of time. The refrigerator includes a food storage compartment, wherein food is always kept fresh at a low temperature due to a constant cooling cycle. In order to refrigerate the food storage compartment, the refrigerator includes a compressor, a condenser, a heat exchanger, a blower fan, and a refrigerant tube.

Each assembly part of the refrigerator will now be described.

The compressor compresses and circulates the refrigerant. The condenser then condenses the compressed refrigerant into a liquid form. The heat exchanger vaporizes the condensed refrigerant and absorbs the heat within the food storage compartment. The blowing fan blows the cool vapor around the heat exchanger into the food storage compartment. Finally, the refrigerant tube connects the compressor, the condenser, and the heat exchanger.

Meanwhile, a door for opening and closing the refrigerator is provided on a side (e.g., a front side) of the refrigerator. The door includes a hinge-type door and a sliding door.

The hinge-type door is fixed to both upper and lower surfaces of a side of the refrigerator, the door pivoting around the hinge to open and close the refrigerator. Also, the sliding door opens and closes the refrigerator by moving back and forth along a guide provided within the refrigerator.

In addition, a door assembly of a refrigerator is provided on the refrigerator in order to allow a user to open and close the refrigerator. The door assembly of the refrigerator includes a door, a handle, and a handle holder.

The door of the door assembly of the refrigerator is provided on the front side of the refrigerator and opens and closes the refrigerator for storing, putting in, and taking out food from the refrigerator.

Moreover, one end of the handle holder of the door assembly is fixed to the door and another end of the handle holder is attached to the handle.

FIG. 1 illustrates a structure of a related art refrigerator having a sliding door applied therein.

Referring to FIG. 1, the sliding door type refrigerator includes a main body 1, an upper front door, and a lower front door. The door formed on the upper front side of the refrigerator is a hinge-type door 2, whereas the door formed on the lower front side is a sliding door 3.

In addition, a door assembly of a refrigerator is provided to open and close the refrigerator by using the sliding door 3. Herein, the door assembly of the refrigerator includes a sliding door 3, a handle 4, and a handle holder 5.

Each assembly part of the door assembly will now be described in detail.

The sliding door 3 opens and closes the refrigerator, so as to store food therein and to take out the stored food therefrom.

The handle 4 is formed on one side of the sliding door 3, so as to allow the user to open and close the refrigerator door. In addition, the handle holder 5 is provided in order to connect the handle 4 and the sliding door 3. More specifically, one end of the handle holder 5 is fixed to the sliding door 3, and the other end of the handle holder 5 is attached to the handle 4, thereby connecting the sliding door 3 and the handle 4.

Moreover, in order to facilitate the user when opening and closing the sliding door 3, a sliding guide 8 is formed on each side of the sliding door 3 in the related art sliding door type refrigerator. Another pair of sliding guides (not shown) or grooves (not shown), corresponding to the sliding guides 8 of the sliding door 3, is formed on the inner side surfaces of the refrigerator.

FIG. 2 illustrates a cross-sectional view of a related art door assembly of a refrigerator.

Referring to FIG. 2, a fixing part penetrating the handle holder 5 fixes one end of the handle holder 5 to the upper surface of the sliding door 3. Herein, the fixing part is formed of a plurality of screws 6 and 7. More specifically, the screws 6 and 7 include a first screw 6 adjacent to the handle, and a second screw 7 adjacent to the interior of the refrigerator.

Meanwhile, a hole is formed inside the other end of the handle holder 5, whereby each end of the handle 4 is fixed to each hole, so as to be attached to the handle holder 5.

As shown in FIG. 2, in order to open and close the sliding door 3, the user applies force to the upper portion of the handle 4. More specifically, when the user opens and closes the sliding door 3 formed on the lower portion of the refrigerator, the user applies force not only to pull the handle 4, but also to lift the handle 4 upwards. The force applied upwards (or the lifting force F) is represented as an arrow in FIG, 2.

As described above, the upward force F is transmitted to the handle holder 5 connected to the handle 4, thereby causing damage to the handle holder 5. The damage caused to the handle holder 5 will now be described in detail with reference to FIG. 3, FIG. 3 illustrates a damaged part of a handle holder of the related art refrigerator.

Referring to FIG. 3, the lifting force applied to the handle holder 5 causes the force to be concentrated to the hole of the handle holder 5 through which the first screw 6 is penetrated. As the user continuously uses the refrigerator and the sliding door, the same lifting force is constantly and repeatedly applied to handle holder 5. Eventually, as the force accumulates to the hole of the handle holder 5, the handle holder 5 is damaged along the damaged part, as shown in FIG. 3.

As described above, the related art door assembly of the refrigerator has the following disadvantages.

In the related art door assembly of the refrigerator, the applied force is concentrated at only one portion of the handle holder. Therefore, continuous and repeated usage causes damage to the handle holder.

SUMMARY OF THE INVENTION

Accordingly, the present invention is directed to a door assembly of a refrigerator that substantially obviates one or more problems due to limitations and disadvantages of the related art.

An object of the present invention is to provide a door assembly of a refrigerator having a supporting member formed on a handle holder, so as to prevent the handle holder from being damaged.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a door assembly of a refrigerator includes a door opening and closing the refrigerator, a handle provided on a side of the door, a plurality of handle holders each having an end fixed to the door and another end attached to the handle, and a supporting member provided on each of the handle holders and preventing damage from occurring on the handle holder.

The supporting member is protruded downwards on a lower surface of the handle holder. And, the supporting member is provided on a contacting surface between the handle holder and the door.

Herein a width of the supporting member is smaller than that of the handle holder.

And, the supporting member is integrated with the handle holder.

In addition, a groove for inserting the supporting member is formed on the door. Herein, a depth of the groove is the same as a thickness of the supporting member.

The handle holder is fixed to the door by a fixing part penetrating the handle holder, wherein the fixing part is a screw. Herein, at least two (2) screws are provided to fix the handle holder to the door.

The supporting member is provided at a surrounding region of a hole through which the screws are penetrated.

And, the supporting member is formed on a lower surface of a surrounding region of a hole through which a screw closer to the handle is penetrated.

Herein, the door is a sliding door, and the handle is formed on a front side of the refrigerator. The handle holder is formed on each side of the handle.

In another aspect of the present invention, a door assembly of a refrigerator includes a door opening and closing the refrigerator, a handle provided on a side of the door, a plurality of handle holders each having an end fixed to the door and another end attached to the handle and each having a supporting member protruded downwards at a lower surface of each handle holder, and a groove formed on the door and having the supporting member inserted therein.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

The door assembly of the refrigerator according to the present invention will now be described in detail with reference to the accompanying drawings.

Figure 1:
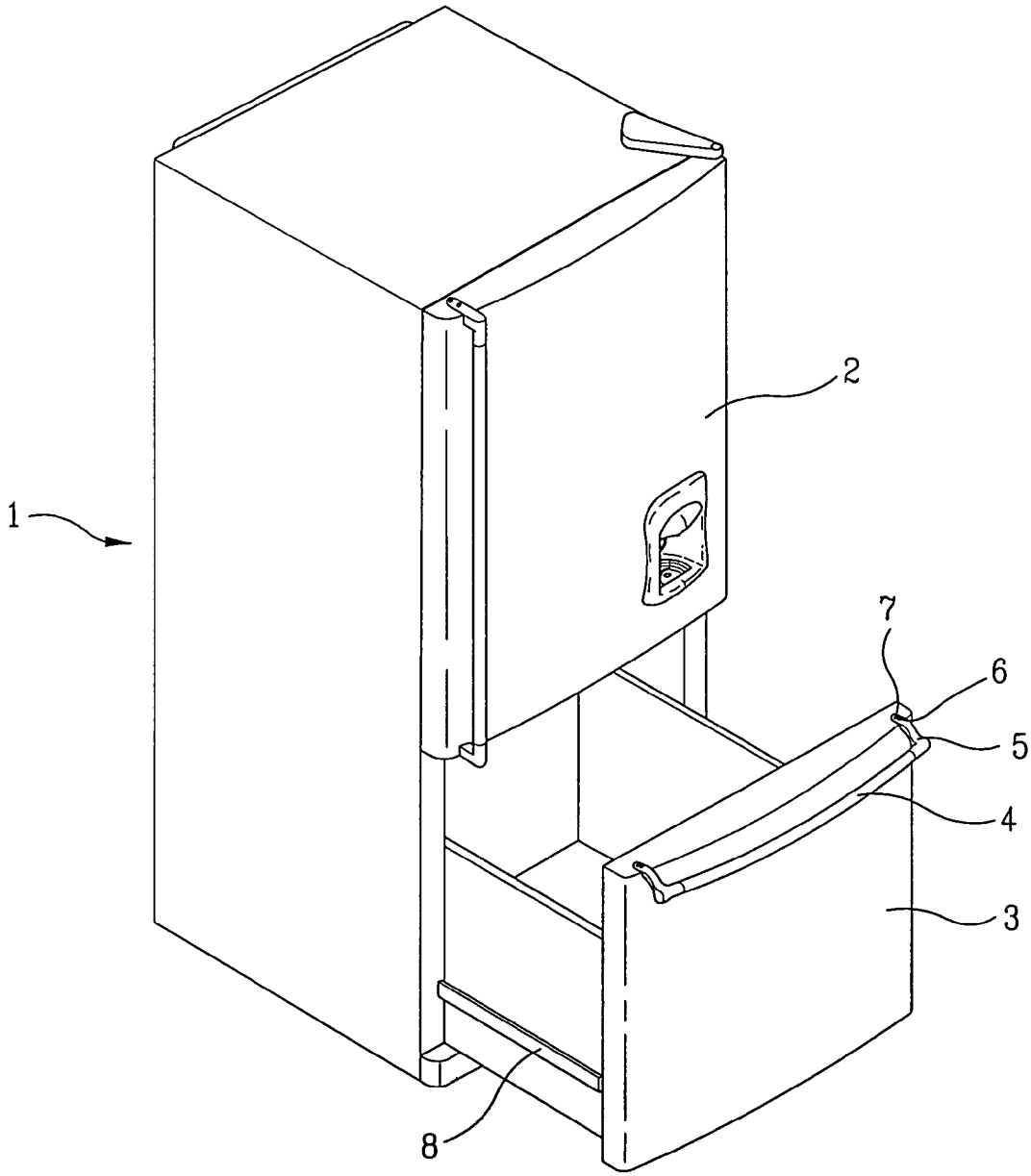
FIG. 1 Related Art
FIG. 1 illustrates a related art refrigerator.
Figure 2:
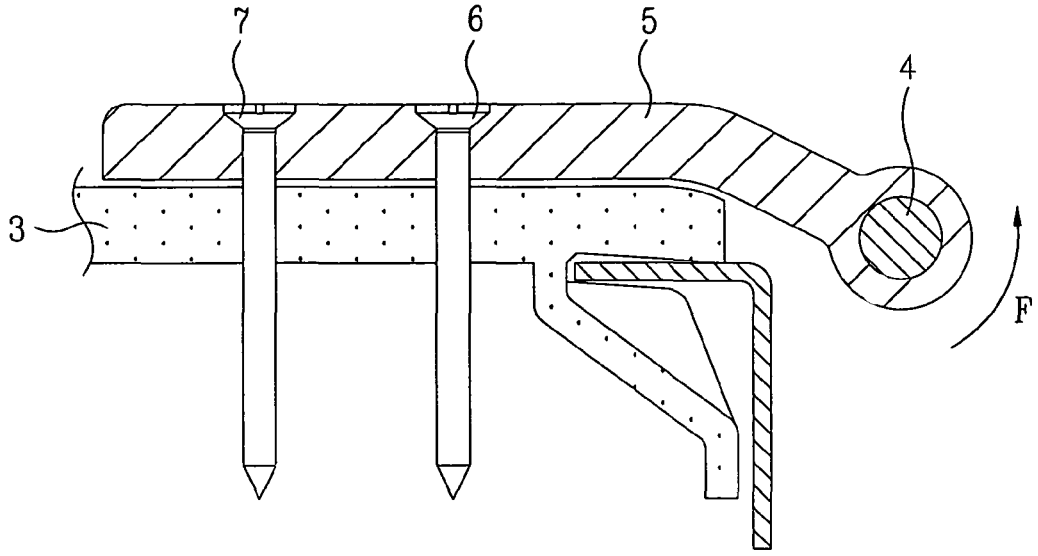
FIG. 2 Related Art
FIG. 2 illustrates a cross-sectional view of a related art door assembly of a refrigerator.
Figure 3:
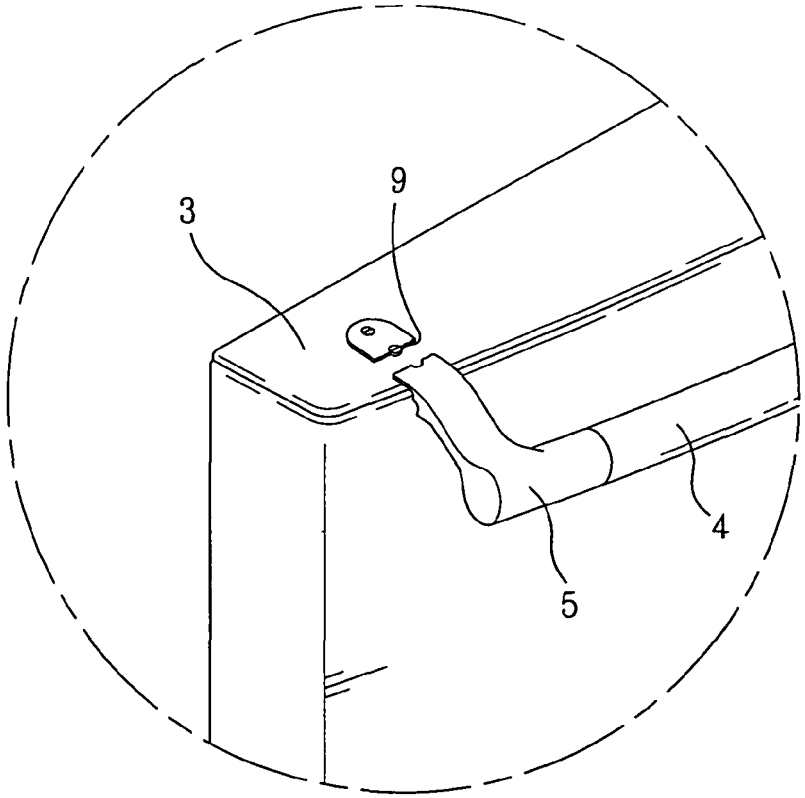
FIG. 3 Related Art
FIG. 3 illustrates a damaged part of a handle holder of the related art refrigerator.
Figure 4:
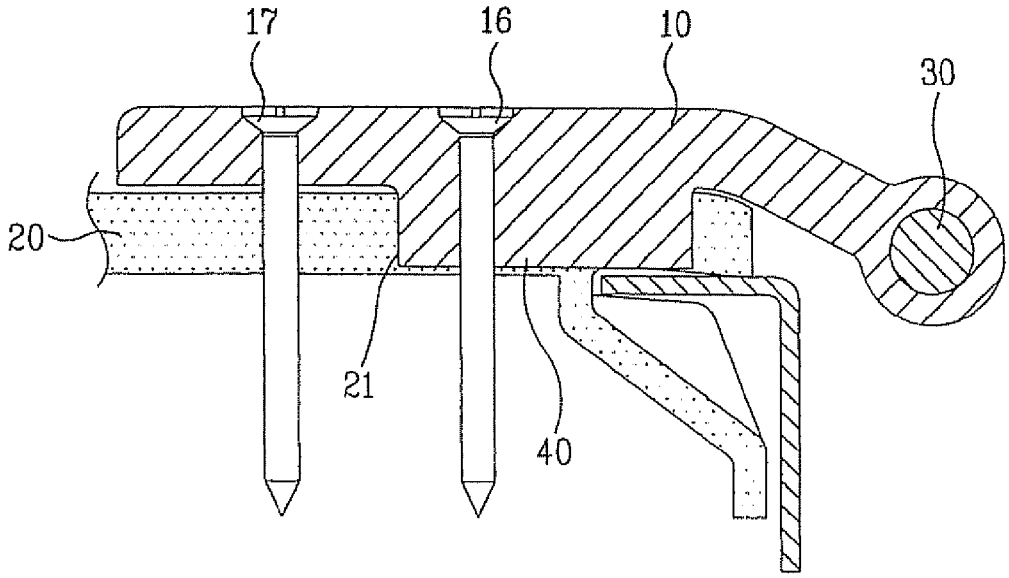
FIG. 4 illustrates a cross-sectional view of a door assembly of a refrigerator according to the present invention.

FIG. 4 illustrates a cross-sectional view of a door assembly of a refrigerator according to the present invention.

Referring to FIG. 4, the door assembly of the refrigerator according to the present invention includes a door 20, a handle 30, a handle holder 10, and a supporting member 40. The cross-sectional view of the handle holder 10 in FIG. 4 is taken from the section line IV-IV of FIG. 5.

The door 20 of the door assembly of the refrigerator is opened and closed to store food within and to take out food from the refiigerator. Also, the door 20 is located on the front side of the refrigerator.

The handle of the door assembly of the refrigerator is located on a side of the door 20, so as to allow the user to open and close the door 20 of the refrigerator. In addition, one end of the handle holder 10 is fixed to the door 20, and the other end of the handle holder 10 is attached to the handle 30.

Moreover, the supporting member 40 of the door assembly of the refrigerator located on the handle holder 10 is formed to reinforce the handle holder 10, thereby preventing damage from occurring.

The position and the shape of the supporting member 40 provided in the present invention will now be described in detail.

In order to enhance the appearance of the refrigerator, the supporting member 40 is located on the lower surface of the handle holder 10 and protruded downwards. Also, in order to further enhance the outer feature of the refrigerator, the supporting member 40 is provided on a surface where the handle holder 10 contacts the door 20.

Moreover, in order to reduce material costs, the supporting member 40 is provided with a width smaller than that of the handle holder 10. Herein, the supporting member 40 is integrated with the handle holder 10, so as to facilitate the fabrication process of the supporting member 40.

Meanwhile, a fixing part penetrating the handle holder 10 fixes the handle holder 10 to the door 20. Herein, the fixing part can be formed of rivets. However, in order to facilitate the attachment of the handle holder 10 to the door 20, the fixing part is comprised of screws 16 and 17. Also, at least two (2) screws 16 and 17 are provided, so as to stably fix the handle holder 10 to the door 20.

Specific movements or operations of the door assembly of the refrigerator according to the present invention will now be described in detail.

When the user opens or closes the door 20, the user holds the handle 30 and applies force thereto. The force applied to the handle 30 can be divided into a pulling force and a lifting force. The lifting force is transmitted to the handle holder 10 connected to the handle 30. The force transmitted to the handle holder 10 causes damage to the portion of the handle holder 10 surrounding the holes 13 and 14, through which the screws 16 and 17 fixing the handle holder 10 to the door 20 are penetrated, as shown in FIG. 5.

However, in the door assembly of the refrigerator according to the present invention, the supporting member 40 is located on the periphery of the holes 13 and 14, through which the screws 16 and 17 are inserted. Accordingly, the applied force is concentrated at the peripheral area of the holes 13 and 14 penetrated by the screws 16 and 17, thereby preventing damage in the handle holder 10.

Figure 5:
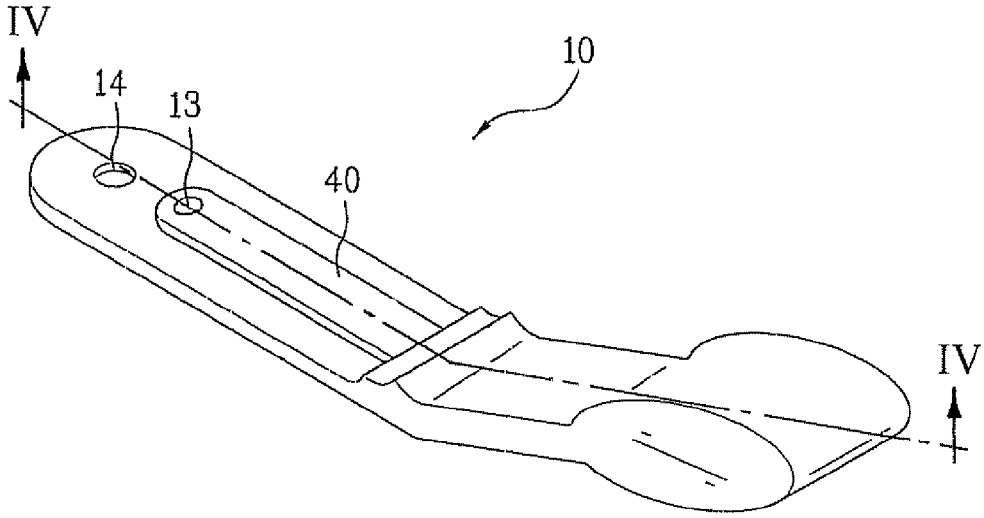
FIG. 5 illustrates a perspective view of a handle holder of the door assembly of the refrigerator according to the present invention.

FIG. 5 illustrates a perspective view of a lower surface of the handle holder of the door assembly of the refrigerator according to the present invention.

In the related art door assembly of the refrigerator, the applied lifting force is concentrated at the hole close to the handle 4, through which the first screw is penetrated. Therefore, as shown in FIG. 5, in order to reduce material costs, the supporting member 40 preventing the handle holder 10 from being damaged is provided on the lower surface surrounding the hole 13 through which the screw 16 is penetrated.

Meanwhile, the handle holder 10 is provided on each side of the handle 30. And, each handle holder 10 holds each side of the handle 30, thereby preventing the handle 30 from being detached from the door 20.

Figure 6:
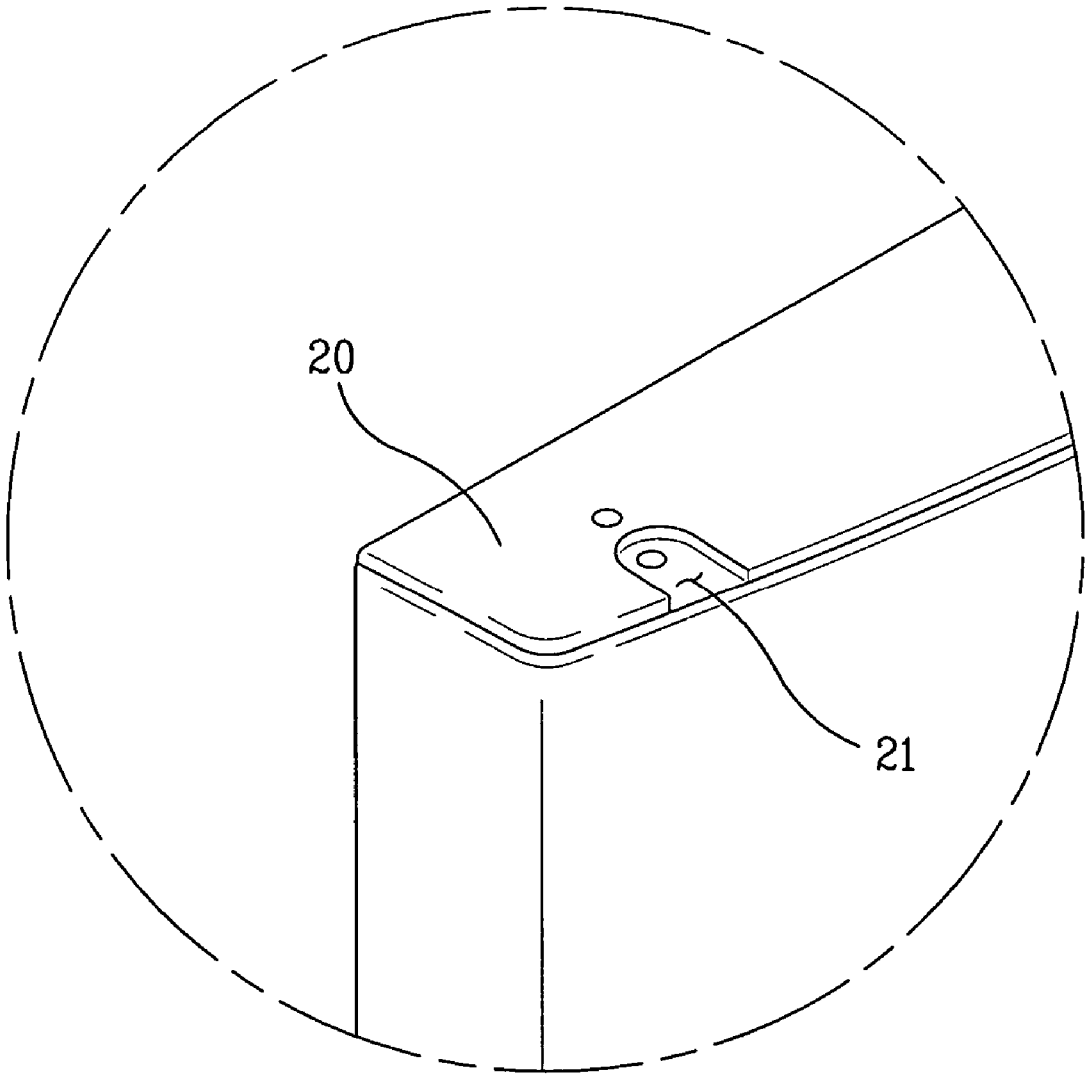
FIG. 6 illustrates a perspective view showing an upper portion of a door of the door assembly according to the present invention.

FIG. 6 illustrates a perspective view showing an upper portion of a door of the door assembly according to the present invention.

Referring to FIG. 6, a groove 21 having the supporting member 40 inserted therein is provided in the door 20. The groove 21 is provided on the upper surface of the door 20.

The depth of the groove 21 provided on the door 20 is the same as the length of the supporting member 40. Since the supporting member 40 fits the groove 21 provided on the upper surface of the door 20, the handle holder 10 can be stably fixed to the door 20.

In addition, when fixing the handle holder 10 to the door 20, the supporting member 40 and the groove 21 accurately guide the handle holder 10 to its exact location. Due to the above-described structure, the location of the handle holder 10 can be easily found, thereby enhancing the manufacturing efficiency and facilitating the manufacturing process.

Moreover, since the supporting member 40 provided on the handle holder 10 cannot be seen through the naked eyes of the user, the outer feature of the present invention is also enhanced.

In the present invention, the door assembly of the refrigerator is preferably provided on a sliding door. However, the door assembly of the refrigerator according to the present invention can also be provided of a hinge-type door.

As aforementioned, the door assembly of the refrigerator according to the present invention has the following advantages.

The door assembly of the refrigerator includes a handle holder having a supporting member supporting the weak area of the handle holder, thereby preventing damage from occurring in the handle holder.

In addition, the supporting member is inserted into a hole provided on the door of the refrigerator, so as to prevent the supporting member from being seen from the outside, thereby enhancing the outer feature of the refrigerator according to the present invention.

Finally, when the handle holder is fixed to the door, a hole guiding the handle holder is also provided, thereby facilitating the manufacturing process.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A refrigerator door assembly, comprising:

a sliding door configured to be slid open and closed;

a handle provided on a top edge surface of the door; and a plurality of handle holders each having an end fixed to the door and another end attached to the handle, wherein the end fixed to the door comprises:

a handle holder member extended to the handle; and a supporting member protruded in a first direction on a lower surface of the handle holder member and receivable within a groove provided in the door, preventing damage from occurring on the handle holder, wherein the supporting member is disposed between the handle and a securing mechanism configured to secure a corresponding handle holder to the side of the door so as to absorb a force applied to the handle in a second direction opposite to the first direction and reinforce a strength of the handle holder when the sliding door is slid open and closed, and wherein the supporting member is integrally formed with the handle holder such that the supporting member and the handle holder are a single unitary piece.

2. The door assembly according to claim 1, wherein the supporting member is located on a contacting surface between the handle holder and the door.

3. The door assembly according to claim 1, wherein a width of the supporting member is smaller than that of the handle holder.

4. The door assembly according to claim 1, wherein a groove for inserting the supporting member is formed on the door.

5. The door assembly according to claim 4, wherein a depth of the groove is the same as a thickness of the supporting member.

6. The door assembly according to claim 1, wherein the handle holder is fixed to the door by the securing mechanism penetrating the handle holder.

7. The door assembly according to claim 6, wherein the securing mechanism is a screw.

8. The door assembly according to claim 1, wherein the securing mechanism comprises at least two screws provided to fix the handle holder to the door.

9. The door assembly according to claim 8, wherein the supporting member is located at a surrounding region of holes through which the screws are penetrated.

10. The door assembly according to claim 9, wherein the supporting member is located on a lower surface of a surrounding region of a hole through which a screw closer to the handle is penetrated.

11. The door assembly according to claim 1, wherein the handle holder is located on each side of the handle.

12. A handle assembly for a refrigerator door, comprising:

a handle; and a plurality of handle holders each having an end fixed to a door and another end attached to the handle, wherein the end fixed to the door comprises:

a handle holder member extended to the handle; and a supporting member protruded in a first direction at a lower surface of each handle holder member and receivable within a groove provided in the door, wherein the supporting member is disposed between the handle and a securing mechanism configured to secure a corresponding handle holder to the side of the door so as to absorb a force applied to the handle in a second direction opposite to the first direction and reinforce a strength of the handle holder when the door is slid open and closed, and wherein the supporting member is integrally formed with the handle holder such that the supporting member and the handle holder are a single unitary piece.

* * * * *